US005218749A

United States Patent [19]

Upthegrove

[11] Patent Number: 5,218,749

[45] Date of Patent: Jun. 15, 1993

[54] PUNCH TOOL ASSEMBLY WITH REMOVABLE PUNCH SEGMENTS

[76] Inventor: Robert Upthegrove, P.O. Box 147, Opa Locka, Fla. 33054

[21] Appl. No.: 871,660

[22] Filed: Apr. 21, 1992

[51] Int. Cl.[5] ..... B25B 27/14

[52] U.S. Cl. ..... 29/275; 30/358; 30/366

[58] Field of Search ..... 29/275, 254–255; 90/275; 30/119, 358, 366; 10/16, 7; 227/151; 72/412, 324, 478, 477; 83/71; 173/90, 131, 132, 128; 81/463

[56] References Cited

U.S. PATENT DOCUMENTS

| | | | |
|---|---|---|---|
| 1,487,592 | 3/1924 | Novotny . | |
| 1,541,078 | 6/1925 | Sudweeks | 30/366 |
| 1,863,956 | 6/1932 | Wilson . | |
| 2,013,758 | 9/1935 | Livermore | 72/477 |
| 2,145,725 | 1/1939 | Jamieson | 30/366 |
| 2,284,522 | 5/1942 | Keen | 29/275 |
| 2,339,258 | 1/1944 | Engh . | |
| 2,441,981 | 5/1948 | Stelzer . | |
| 2,860,535 | 11/1958 | Fowler . | |
| 2,861,330 | 11/1958 | Kratz . | |
| 2,938,412 | 5/1960 | Walker | 72/477 |
| 3,083,449 | 4/1963 | Simmons . | |
| 3,099,079 | 7/1963 | Stein . | |
| 3,239,933 | 3/1966 | Nakata | 30/358 |
| 3,327,516 | 6/1967 | Anderson | 173/131 |
| 3,651,553 | 3/1972 | Dodd . | |
| 3,942,234 | 3/1976 | Kepler . | |
| 4,229,870 | 10/1980 | Tate | 29/275 |
| 4,460,050 | 7/1984 | Schmidt | 173/131 |
| 4,586,228 | 5/1986 | Rodolf | 29/275 |
| 4,926,537 | 5/1990 | Pool | 29/275 |
| 5,001,822 | 3/1991 | Upthegrove | 29/275 |

*Primary Examiner*—Robert C. Watson

*Attorney, Agent, or Firm*—Don J. Flickinger; Jordan M. Meschkow; Robert A. Parsons

[57] ABSTRACT

A handheld punch tool assembly having individual removable punch segments formed of a high strength material capable of being struck repeatedly by a striking instrument, each of the individual punch segments including a substantially flat punch surface on one end thereof structured to engage in abutting relation with a substantially flat corresponding surface to be punched. Each of the individual punch segments have a different transverse dimension than a remainder of the punch segments so as to effectively vary the size of the punch surface. The individual punch segments are removably attachable to one another to form an elongate, multi-punch segment body of variable length. A plurality of various size collar members are each individually structured to be removably fitted about a corresponding one of the punch segments so as to effectively increase the transverse dimension and accordingly, the size of the punch surface of that particular punch segment.

1 Claim, 2 Drawing Sheets

PUNCH TOOL ASSEMBLY WITH REMOVABLE PUNCH SEGMENTS

BACKGROUND OF THE INVENTION

1. Field of the Invention

The present invention is directed to a punch tool assembly including a plurality of individual punch segments of varying transverse dimension, the individual punch segments being removably attachable to one another to form an elongate, multi-punch segment body of varied length in accordance with the needs of a user.

2. Description of the Related Art

There are numerous punch structures in the related art having a variety of structural configurations for a variety of uses. Generally, most punch structures are made in a series of different sizes, wherein a user is required to select a particular size to be utilized in order to perform the required function. For example, it is generally required to use a punch tool on a bearing assembly for the removal of a race structure therefrom, wherein the punch tool is held in position and by striking on one end of the tool with a mallet or hammer the components of the bearing assembly are separated.

In an attempt to solve the problem associated with having to use a number of different size punches in order to accommodate for varying size bearing assemblies, I previously developed a multi-segment punch assembly which is fully illustrated and described in U.S. Pat. No. 5,001,822. My invention for the multi-segment punch assembly includes an integrally formed elongate base of a one piece construction which has a plurality of punch segments formed therealong, each of the punch segments being successively positioned so as to increase in transverse dimension by a predetermined increment successively from one end towards an opposite end. Each of the punch segments are specifically sized for mating, abutting engagement with a corresponding surface to be punched. While my multi-segment punch assembly has been found to be useful for its intended purpose, through continued use, I found that it was sometimes desirous to have the ability to vary the length of the overall assembly in order to prevent the end of the structure from engaging an object before the punch surface of a particular desired segment is able to engage the surface to be punched. It is also necessary to increase the overall length of a particular punch segment when necessary in order to effectively punch a race structure or other annular or cylindrical structure a significant distance.

The plurality of punch segments on my multi-segment punch assembly, as set forth in U.S. Pat. No. 5,001,822, were each specifically designed to have a particular transverse dimension different from a remainder of the punch segments. However, my multi-segment punch assembly does not accommodate for bearing structures, or other structures to be punched, having sizes different than those of the particular transverse dimension of the various punch segments, such as metric sizes and various non-standard sizes.

Accordingly, in view of the problems associated with the punch structures in the related art, the present invention is specifically designed to include a plurality of individual punch segments which are removably attachable to one another to form a multi-punch segment assembly of variable length and dimensions. Further, in order to accommodate for varying sizes of structure to be punched, the present invention includes a plurality of different sized collars, each being specifically structured to be fitted over a particular punch segment so as to effectively increase the transverse dimension thereof.

SUMMARY OF THE INVENTION

The present invention is directed to a punch tool assembly designed to be handheld and including a plurality of individual, removable punch segments which are formed of a high strength material capable of withstanding repeated blows thereto with a striking instrument. Each of the individual punch segments have a different transverse dimension and include a substantially flat surface formed on one end thereof being structured and configured to engage in abutting relation with a substantially flat corresponding surface to be punched. The individual punch segments are removably attached to one another along a common axis so as to form a multi-punch segment elongate body which is variable in overall length and transverse dimension.

A plurality of collars are individually sized and configured to be fitted about a corresponding individual punch segment in such a manner so as to effectively increase the overall transverse dimension thereof, and thus the transverse dimension of the punch surface.

Accordingly, in view of the foregoing, it is an object of the present invention to provide a punch tool assembly which includes a plurality of individual punch segments of different transverse dimension, wherein each of the individual punch segments are removably attachable to one another so as to form a substantially elongate multi-punch segment body which is variable in overall length and transverse dimension.

It is another object of the present invention to provide a punch tool assembly having a plurality of individual punch segments, each of different transverse dimension, wherein each of the individual segments are removably attachable to one another along a common axis in such a manner so as to enable the difference in transverse dimension between adjacent punch segments to be varied in accordance with the needs of the user.

It is a further object of the present invention to provide a punch tool assembly having a plurality of individual punch segments, each of different transverse dimension, wherein the individual punch segments are removably attachable to one another to form a uniform, multi-punch segment assembly which can be limited so as to include only those punch segments which are required by the particular user.

It is yet a further object of the present invention to provide a punch tool assembly having a plurality of individual punch segments each of different transverse dimension and further including a plurality of collars each individually sized and configured to be removably fitted about a correspondingly sized punch segment so as to effectively increase the transverse dimension thereof.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
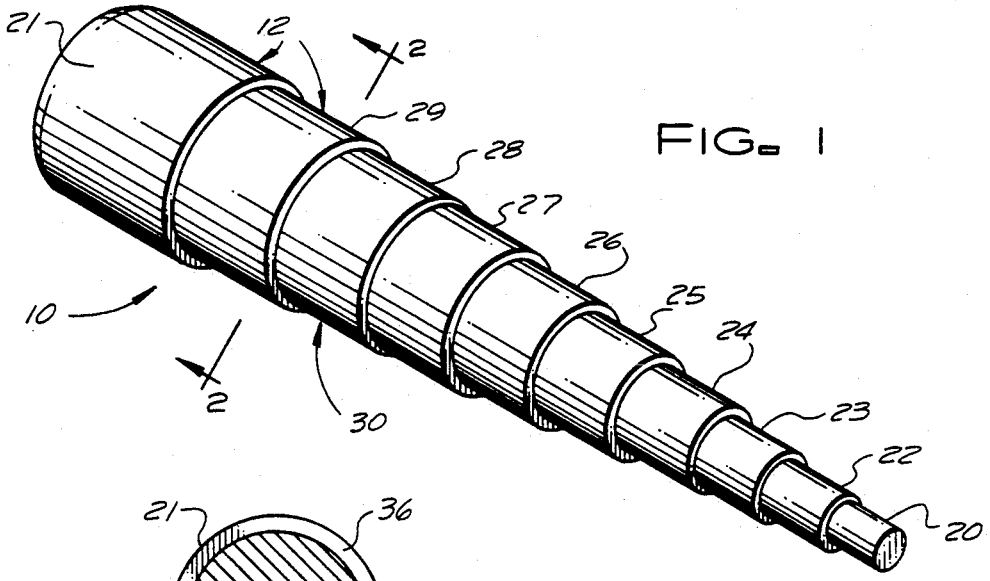
FIG. 1 is a perspective view of the punch tool assembly of the present invention.
Figure 5:
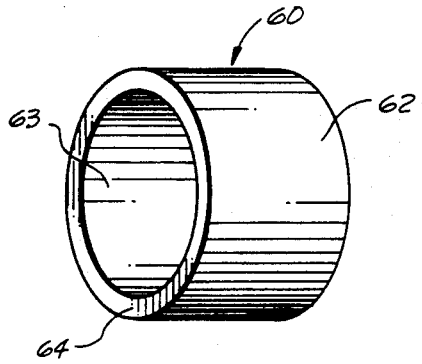
FIG. 5 is a perspective view of a collar member of the present invention.
Figure 6:
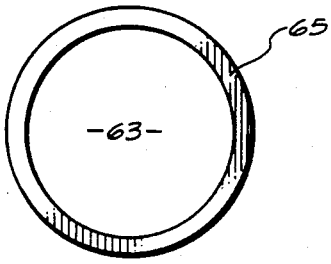
FIG. 6 is a side elevational view of the collar member of FIG. 4.
Figure 7:
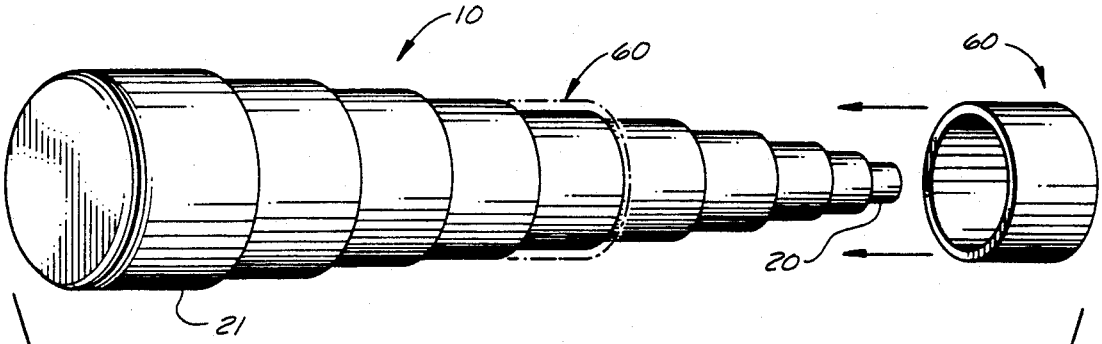
FIG. 7 is an exploded view, shown in perspective, illustrating attachment of the collar member to a punch segment of the punch tool assembly of the present invention.

As shown in FIGS. 1–8, the present invention relates to a punch tool assembly, generally indicated as 10, comprising a plurality of individual punch segments 12, as generally indicated in FIG. 1. The individual punch segments include a first punch segment 20 and a last punch segment 21 as well as a plurality of intermediate punch segments 22, 23, 24, 25, 26, 27, 28, and 29. Each of the individual punch segments 12 are preferably formed of a high strength material such as steel capable of withstanding repeated blows or a striking force from a striking instrument such as a mallet or other like instrument (not shown). The individual punch segments are each individually removably attachable to one another so as to form a uniform, substantially elongate multi-segment body 30, as best seen in FIGS. 1 and 7.

Figure 2:
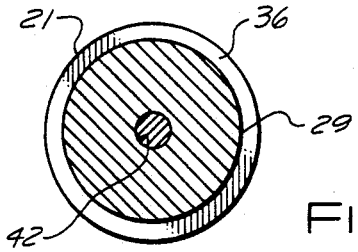
FIG. 2 is an end view taken along line 2—2 of FIG. 1.

The individual punch segments each include an outer side wall 34, which preferably varies in length in proportion with a transverse dimension of each of the individual punch segments. The individual punch segments are each characterized by a specific transverse dimension or diameter. In this manner, a substantially flat punch surface 36 formed on one end of each of the punch segments is at least partially exposed when a second punch segment of lesser transverse dimension is attached thereto, as best seen in FIG. 2. For example, in FIG. 2, an end view is seen of intermediate punch segment 29 attached to the last punch segment 21, wherein the transverse dimension of punch segment 21 is greater than the transverse dimension of punch segment 29 so as to readily expose the flat punch surface 36.

Figure 3:
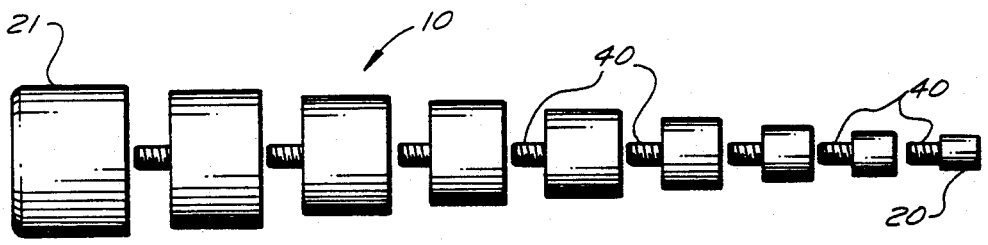
FIG. 3 is an exploded view of the punch tool assembly of the present invention.
Figure 4:
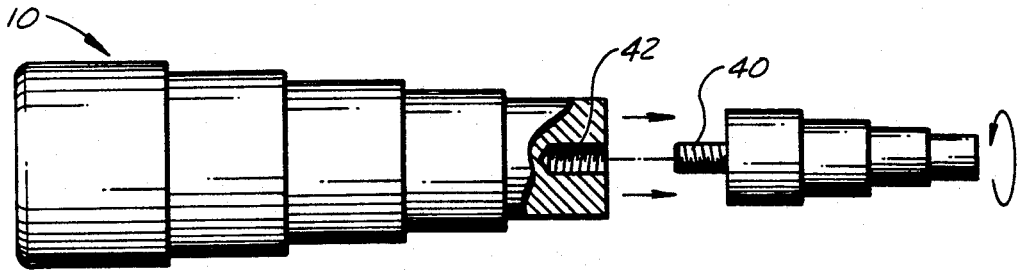
FIG. 4 is a side elevation view of the punch tool assembly of the present invention shown partially disassembled.

As seen in FIG. 3, each of the individual punch segments 12 are removably attachable to one another such that the overall length of the uniform body 30 can be varied depending upon the number of individual segments attached in series. Thus, in use, if the first punch segment 20 were to engage with an obstructing structure before the flat punch surface of punch segment 26 was able to engage with a corresponding surface, such as that of a bearing or other annular or cylindrical structure to be punched, then first punch segment 20 as well as additional punch segments could be removed so as to effectively reduce the overall length of the assembly, as seen in FIG. 4. In this manner, the punch surface of punch segment 26 could effectively engage the corresponding surface to be punched without any interference with a remainder of the assembly with obstructing structures.

In a preferred embodiment, each of the individual punch segments, with the exception of either the first or the last punch segment, have a threaded shaft 40 extending co-axially from one end thereof opposite of the punch surface. The threaded shaft 40 is structured and disposed for threaded engagement with a threaded bore 42 formed in an opposite end of each of the individual punch segments as best seen in FIG. 4. In this manner, any desired number of individual punch segments 12 can effectively be co-axially attached in accordance with a desired overall length and transverse dimension.

Figure 8:
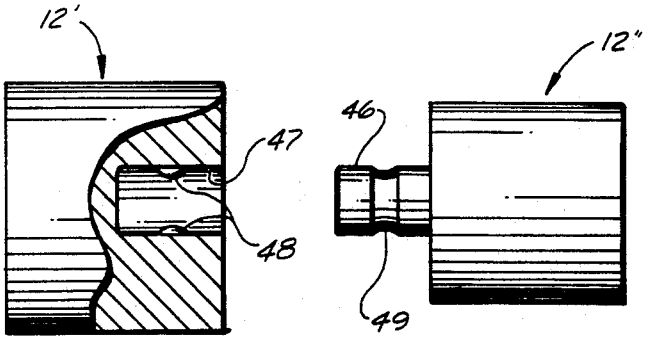
FIG. 8 is an isolated view illustrating another embodiment of the attachment means of the present invention.

Another embodiment of the attaching means of the present invention is seen in FIG. 8 and includes a post 46 which extends from one end of each of the individual punch segments with the exception of either the first segment 20 or the last segment 21. The post is structured to be received within a chuck 47 such that bearings 48 within the chuck 47 lockingly engage within a groove 49 formed about the post 46, thereby effectively locking one punch segment 12' to a next adjacent punch segment 12''. It should be noted that any of the individual punch segments 12 can effectively be attached to any other individual punch segment as desired by the user. Therefore, some of the intermediate punch segments such as 25–28 could be removed with punch segment 24 being attached directly to punch segment 29. Alternatively, a portion of the entire body 30 may be removed, as best seen in FIG. 4, so as to effectively reduce the overall length of the body with punch segment 25 now becoming the first segment in the series.

The present invention also includes a plurality of various size collar members 60, one of such collar members 60 being shown in FIGS. 5–7. Each of the plurality of individual collar members 60 includes an outer cylindrical wall 62 defining a transverse dimension of the collar member. Each of the collar members 60 further include a hollow axial bore 63 extending therethrough, the diameter of the bore 63 varying with each of the plurality of collar members and being specifically sized for mating engagement about the outer side wall of a corresponding one of the plurality of individual punch segments 12, as seen in FIG. 7. Each of the collar members 60 further include opposite ends 64, 65 as seen in FIGS. 5 and 6, with one of the opposite ends adapted for mating engagement with a punch surface of a next adjacent punch segment. The other end of the collar member 60 is preferably flush with the flat punch surface of the punch segment to which the collar member 60 is fitted about. Therefore, with the collar member 60 fitted about a particular punch segment 12, the transverse dimension of the particular punch segment and accordingly its punch surface is effectively increased. In this manner, the effective transverse dimension of the particular punch segment is defined by the overall transverse dimension, or diameter, of the collar member 60 fitted thereabout. If it is thus desirous to change the transverse dimension of a particular individual punch segment 12 to a larger transverse dimension, including a metric size, then a desired size collar member 60 may be fitted thereabout to achieve the desired transverse dimension of the punch segment and accordingly its punch surface.

What is claimed is:

1. A punch tool assembly for striking cylindrical structures and designed to be handheld, comprising:

a plurality of individual punch segments formed of a hard, high strength material capable of withstanding repeated blows thereto with a striking instrument and each including an outer side wall and a different transverse dimension than a remainder of said plurality of punch segments, each of said individual punch segments including a substantially flat punch surface formed on one end thereof and being substantially perpendicular to said outer side wall, said punch surface formed and configured to engage in abutting relation with a substantially flat corresponding surface of a selected one of said structures to be punched, attachment means on each of said individual punch segments for removable, co-axial attachment of each of said individual punch segments to next, adjacent punch segment so as to form a uniform, substantially elongate multi-punch segment body comprising at least two of said attached individual punch segments, and said attachment means including a post extending from a surface of one of said individual punch segments and a bore extending into another of said individual punch segments for receiving said post, said post and said bore having respective elements of complementary means locking said post within said bore, whereby the best punch can be selected by attaching or removing said individual punch segments.

* * * * *